US009758325B2

(12) United States Patent
Takeuchi

(10) Patent No.: US 9,758,325 B2
(45) Date of Patent: Sep. 12, 2017

(54) IMAGE FORMING APPARATUS

(71) Applicant: KYOCERA Document Solutions Inc., Osaka (JP)

(72) Inventor: Naoki Takeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/979,468

(22) Filed: Dec. 27, 2015

(65) Prior Publication Data

US 2016/0185138 A1 Jun. 30, 2016

(30) Foreign Application Priority Data

Dec. 26, 2014 (JP) ..... 2014-265513

(51) Int. Cl.
*B65H 3/44* (2006.01)
*B65H 5/26* (2006.01)
(Continued)

(52) U.S. Cl.
CPC ..... *B65H 5/26* (2013.01); *B41J 13/103* (2013.01); *B65H 1/266* (2013.01); *B65H 5/36* (2013.01);
(Continued)

(58) Field of Classification Search
CPC . B65H 1/266; B65H 5/26; B65H 5/36; B65H 5/38; B65H 7/02; B65H 7/18;
(Continued)

(56) References Cited

U.S. PATENT DOCUMENTS 7,938,392 B2 * 5/2011 Saito ..... B65H 3/44 271/9.03
2009/0189330 A1 * 7/2009 Saito ..... B65H 3/44 271/9.05

(Continued)

FOREIGN PATENT DOCUMENTS

JP 04012962 A * 1/1992
JP H06-064767 A 3/1994

(Continued)

*Primary Examiner* — Prasad Gokhale
(74) *Attorney, Agent, or Firm* — Hawaii Patent Services; Nathaniel K. Fedde; Kenton N. Fedde

(57) ABSTRACT

Provided is an image forming apparatus that, even when a paper feeding cassette is open, positively performs paper feeding from a manual feed tray, and yet shortens the printing interrupt time. Image forming apparatus includes a paper feeding cassette, guide member, paper feeding changeover determining part, and system control part. Paper feeding cassette is detachably loaded in an apparatus main body. Guide member is temporarily fixed in apparatus main body above paper feeding cassette, constituting a carrying passage for a paper sheet from manual feed tray. If paper feeding cassette is drawn out from apparatus main body, paper feeding changeover determining part determines whether or not paper feeding can be changed over to that from manual feed tray. If the result of determination by paper feeding changeover determining part shows that changeover is possible, system control part causes paper feeding from manual feed tray to be performed.

4 Claims, 5 Drawing Sheets

(51) Int. Cl.

| | |
|---|---|
| ***B65H 1/26*** | (2006.01) |
| ***B65H 7/20*** | (2006.01) |
| ***B41J 13/10*** | (2006.01) |
| ***G03G 15/00*** | (2006.01) |
| ***B65H 5/36*** | (2006.01) |
| ***B65H 7/04*** | (2006.01) |

(52) U.S. Cl.
CPC ..... *B65H 7/04* (2013.01); *B65H 7/20* (2013.01); *G03G 15/6508* (2013.01); *G03G 15/6514* (2013.01); *B65H 2405/324* (2013.01); *B65H 2407/21* (2013.01); *B65H 2511/52* (2013.01); *B65H 2513/42* (2013.01); *B65H 2515/10* (2013.01); *G03G 2215/00675* (2013.01)

(58) Field of Classification Search
CPC .. B65H 7/20; B65H 2404/50; B65H 2404/60; B65H 2405/10; B65H 2405/32; B65H 2405/354; B65H 2407/20; B65H 2407/21; B65H 7/04; B65H 2511/52; B65H 2515/10; B65H 2405/324; G03G 15/6508; G03G 15/6514; B41J 13/103
USPC ..... 271/9.01, 9.02, 9.03, 9.09
See application file for complete search history.

(56) References Cited

U.S. PATENT DOCUMENTS

| | | | | |
|---|---|---|---|---|
| 2009/0261524 | A1* | 10/2009 | Nakayama | B65H 3/44 271/3.14 |
| 2013/0221612 | A1* | 8/2013 | Harada | B65H 5/062 271/272 |
| 2013/0228967 | A1* | 9/2013 | Maeda | B65H 1/00 271/264 |
| 2014/0339762 | A1* | 11/2014 | Yanase | B65H 1/266 271/160 |

FOREIGN PATENT DOCUMENTS

| | | | |
|---|---|---|---|
| JP | 2008-105781 | A | 5/2008 |
| JP | 2013-173578 | A | 9/2013 |

* cited by examiner

FIG.4

210a 210b (Paper feeding changeover possible/impossible information table) 210c 210d 210e 210

| | Paper sheet type | Paper sheet size | Paper sheet weight | Paper sheet impact force | Paper feeding changeover possible/impossible indication |
|---|---|---|---|---|---|
| 211a | A 4 (thin) | 297 mm × 210 mm | *** g | ***kg·m/s | Possible |
| 211b | A 4 (thick) | | *** g | ***kg·m/s | Impossible |
| 211c | A 3 (thin) | 420 mm × 297 mm | *** g | ***kg·m/s | Impossible |
| 211d | A 3 (thick) | | *** g | ***kg·m/s | Impossible |
| 211e | B 5 (thin) | 257 mm × 182 mm | *** g | ***kg·m/s | Possible |
| 211f | B 5 (thick) | | *** g | ***kg·m/s | Impossible |
| 211g | Official postcard | 148 mm × 100 mm | *** g | ***kg·m/s | Impossible |

Start

S101
Is MFP in course of printing?
No
Yes
S102
Is paper feeding cassette in open state?
No
Yes
S103
Make paper feeding from paper feeding cassette
S104
Is paper sheet loaded on manual feed tray?
No
Yes
S105
Is paper feeding changeover possible?
No
Yes
S106
Display error
S107
Make paper feed from manual feed tray
End

IMAGE FORMING APPARATUS

INCORPORATION BY REFERENCE

This application is based on and claims the benefit of priority from Japanese Patent Application No. 2014-265513 filed on Dec. 26, 2014, the contents of which are hereby incorporated by reference.

BACKGROUND

The present disclosure relates to an image forming apparatus that reads a document to generate image data.

For example, typical image forming apparatuses that are an MFP (Multifunction Peripheral) are often provided with an automatic paper feeding mechanism part that feeds paper sheets stored in a paper feeding cassette one by one to a carrying passage for guiding the fed paper sheet to a printing mechanism part. In addition, in many cases, the image forming apparatus is provided with a manual feed tray on which a variety of paper sheets can be loaded.

By the way, the paper sheet that has been loaded on the manual feed tray is conveyed toward the printing mechanism part by a guide member that constitutes the carrying passage. This guide member is disposed above the paper feeding cassette such that, in the event that the guide member is dropped for some cause, it can be received by the paper feeding cassette.

In other words, the guide member is provided with a plurality of conveyance rollers, and the like, for feeding the paper sheet that is loaded on the manual feed tray. Therefore, there is the possibility that, in the course of feeding the paper sheet that has been loaded on the manual feed tray, the weight of the plurality of conveyance rollers and the paper sheet may deflect the guide member downward to deform it.

In addition, the guide member is often temporarily fixed to such a part as an internal frame of an apparatus main body. Such configuration provides a feature that, in the case where, for example, a paper sheet jam, or the like, is caused on the guide member, the clearance for the carrying passage of the guide member can be widened by releasing the temporary fixing of the guide member to thereby remove the paper sheet clogged in the inside.

In this way, the guide member is temporarily fixed to such a part as a frame inside of the apparatus main body. Thus, the guide member is disposed above the paper feeding cassette, whereby, even if the guide member is dropped, it can be received by the paper feeding cassette. Between the guide member and the paper feeding cassette, there is provided a clearance that is small to the extent that drawing out of the paper feeding cassette from the apparatus main body will not be hindered.

In a typical case where there is given a configuration with which such a paper feeding cassette supports the guide member, a supporting part is projected on the top face of a side restriction member provided in the paper feeding cassette to restrict the position of the paper sheet in a width direction, and with this supporting part, deformation of the guide member is prevented.

SUMMARY

An image forming apparatus according to an embodiment of the present disclosure includes a paper feeding cassette, a guide member, a paper feeding changeover determining part, and a system control part. The paper feeding cassette is loaded in the inside of an apparatus main body in a detachable manner. The guide member is temporarily fixed in the inside of the apparatus main body above the paper feeding cassette, constituting a carrying passage for a paper sheet from a manual feed tray. The paper feeding changeover determining part performs processing to determine whether or not it is possible to change over the paper sheet feeding to that from the manual feed tray, in the case where the paper feeding cassette is drawn out from the inside of the apparatus main body. The system control part performs processing to cause paper sheet feeding from the manual feed tray to be performed, if the result of determination by the paper feeding changeover determining part shows that changeover is possible.

BRIEF DESCRIPTION OF THE DRAWINGS

FIG. 4 gives a paper feeding changeover possible/impossible information table to be referenced by a paper feeding changeover determining part in FIG. 3.

DETAILED DESCRIPTION

Hereinbelow, an embodiment of an image forming apparatus of the present disclosure will be explained with reference to FIG. 1 to FIG. 5. In the following explanation, as an example of the image forming apparatus, the image forming apparatus is assumed to be an MFP (Multifunction Peripheral), which is a multifunctional peripheral that provides multiple operation functions for such jobs as copying, printing, and facsimiling.

Figure 1:
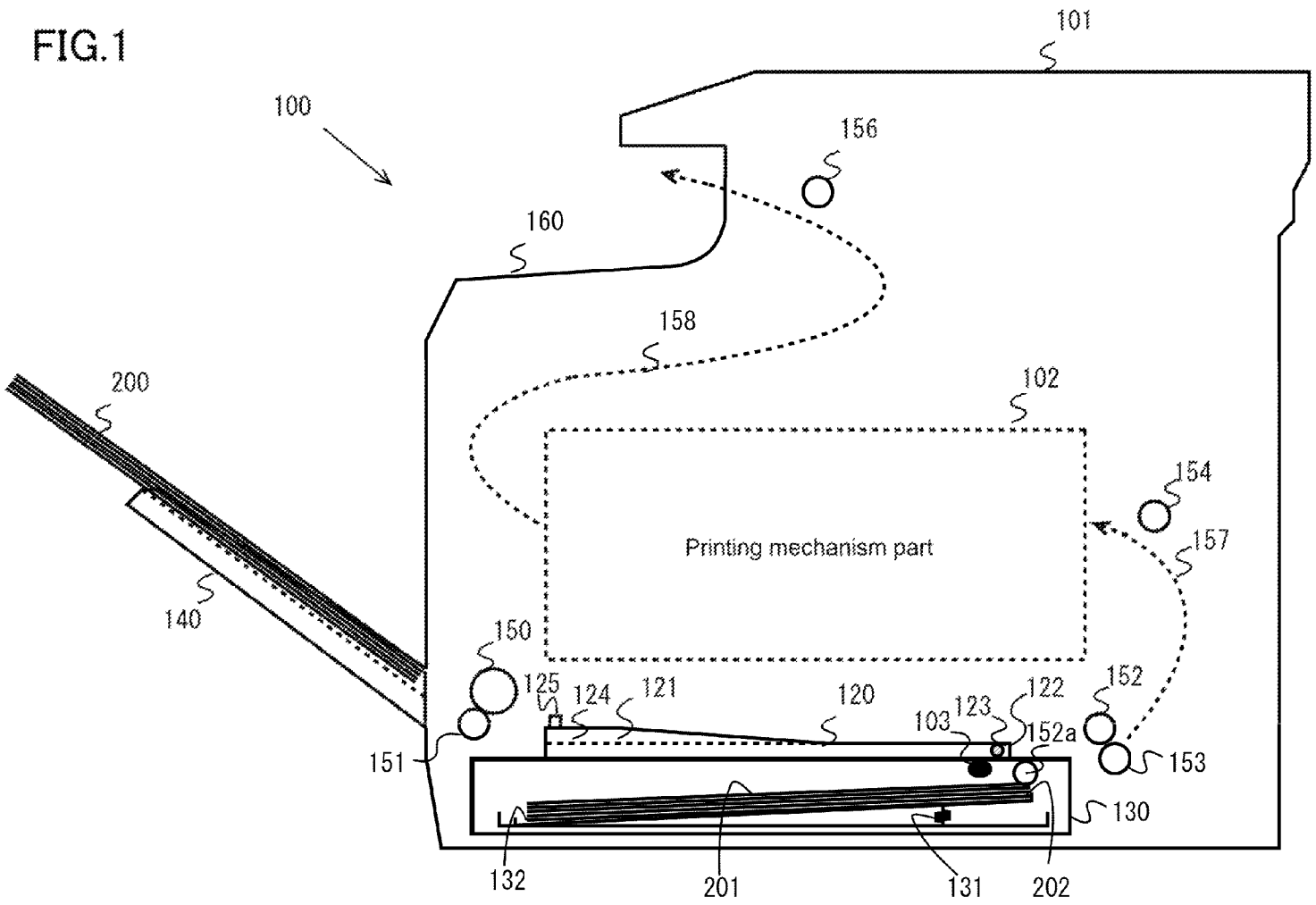
FIG. 1 shows an embodiment in the case where the image forming apparatus in the present disclosure is assumed to be an MFP.

First, as shown in FIG. 1, with an MFP 100, a printing mechanism part 102 having such components as a photosensitive drum is disposed in the inside of the MFP main body 101. Under the printing mechanism part 102, a guide member 120 and a paper feeding cassette 130 are disposed. In addition, the MFP main body 101 is provided with a manual feed tray 140.

When paper sheets 200 that have been loaded on the manual feed tray 140 are fed, a driving roller 150 and a driven roller 151 draw the paper sheets 200 one by one toward a carrying passage 121 of the guide member 120. Then, a driving roller 152 and a driven roller 153 feed out the paper sheet 200 that has been drawn into the carrying passage 121 to the printing mechanism part 102 along a carrying passage 157.

In the vicinity of the printing mechanism part 102, there is disposed a sensing sensor 154 for sensing the paper sheet 200 conveyed by the carrying passage 157. The paper sheet 200, which has been subjected to printing by the printing mechanism part 102, is conveyed to the paper delivery tray 160 by a driving roller and a driven roller along the carrying passage 158. In the vicinity of a paper delivery tray 160, there is disposed a sensing sensor 156 for sensing the paper sheet 200 conveyed by the carrying passage 158.

Here, a distal end part 122 of the guide member 120 is freely turnably supported by such a part as an internal frame of the MFP main body 101 through a shaft 123. At a proximal end part 124 of the guide member 120, there is provided a claw part 125, which is directed upward, for example. The claw part 125 is engaged with a recess part, or the like, that is provided in, for example, the internal frame of the MFP main body 101 of the MFP. With the claw part 125 being engaged with a recess part, or the like, the proximal end part 124 of the guide member 120 is temporarily fixed. The proximal end part 124 of the guide member 120 may be temporarily fixed by a magnet, spring, or the like, instead of the claw part 125. Here, the temporary fixing state is secure to the extent that it will not be eliminated by the own weight of the guide member, even if the paper feeding cassette 130 is drawn out. Therefore, the guide member 120 can maintain its temporarily fixed state even under the condition in which the paper feeding cassette 130 has been drawn out.

Figure 2:
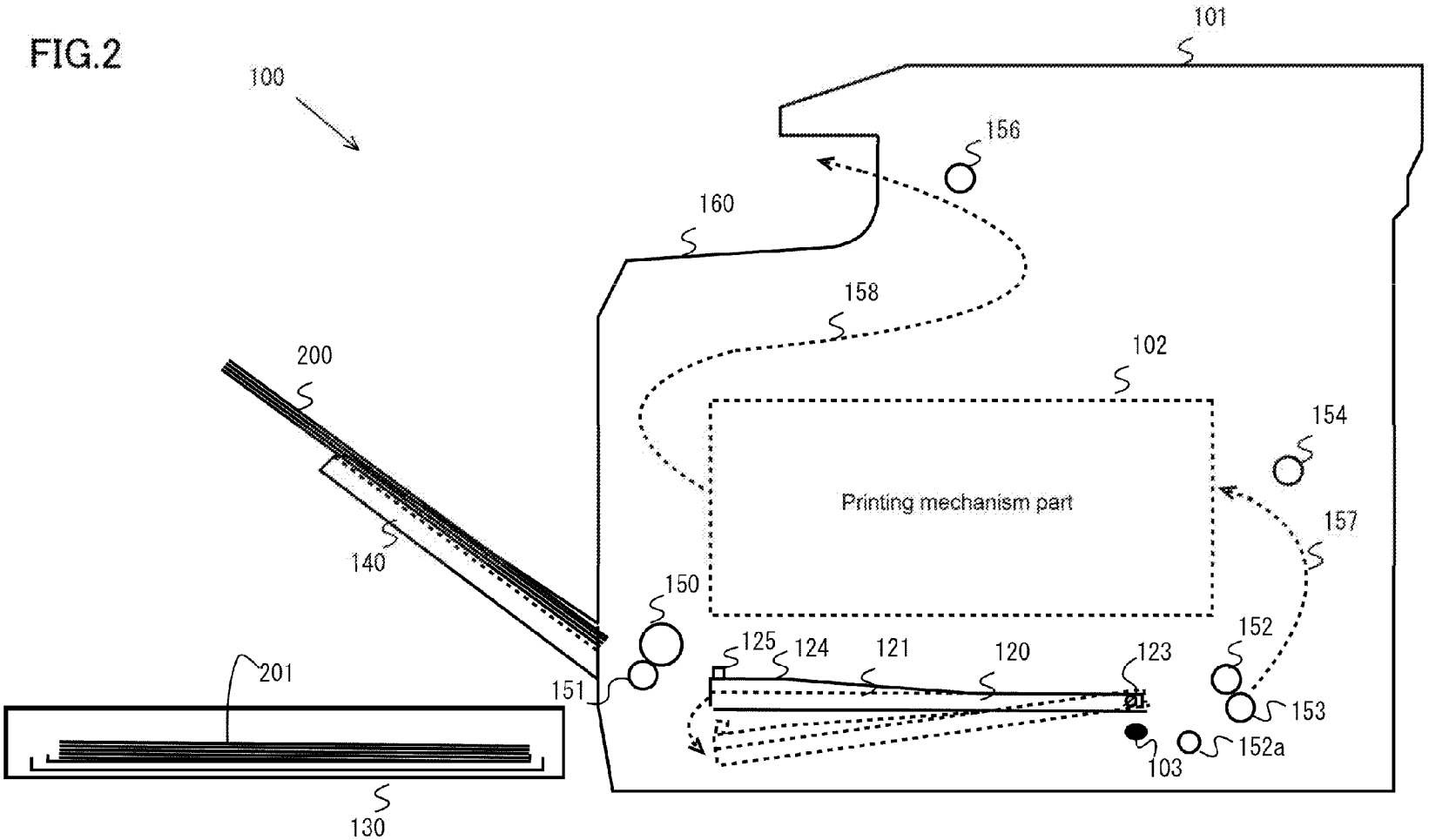
FIG. 2 illustrates the motion of the guide member in FIG. 1.

Thus, in the event that, in the course of feeding a paper sheet 200 from the manual feed tray 140, there is caused a paper sheet jam on the carrying passage 121 of the guide member 120, the paper feeding cassette 130 can be drawn out from the MFP main body 101 as shown in FIG. 2, and the proximal end part 124 of the guide member 120 can be pushed down. At this time, the claw part 125, which is temporarily fixed, is disengaged, and the proximal end part 124 of the guide member 120 will be turned downward around the shaft 123 as a fulcrum. Thereby, the clearance for the carrying passage 121 of the guide member 120 is widened, whereby the paper sheet 200 clogged in the inside can be removed. The guide member 120 is provided with a plurality of conveyance rollers, and the like, for feeding the paper sheet 200 that has been loaded on the manual feed tray 140.

Here, the guide member 120 is disposed above the paper feeding cassette 130. Thus, there is provided a configuration with which, when the paper feeding cassette 130 is in the closed state (is accommodated in the MFP main body 101), the proximal end part 124 of the guide member 120 is supported by the paper feeding cassette 130 so as not to be dropped for some cause.

In addition, the paper feeding cassette 130 is provided with a lifting plate 132, which pushes up one end side 202 of the stored paper sheet 201 by the raising force of a lifting member 131. The lifting member 131 is raised with the paper feeding cassette 130 being brought into the closed state (being accommodated in the inside of the MFP main body 101).

Then, with the lifting plate 132 being pushed up by the lifting member 131, the distal end portion of the paper sheet 201 on the lifting plate 132 is pressed against a feeding roller 152*a*. Thereby, the paper sheets 201 in the paper feeding cassette 130 are fed out one by one by the feeding roller 152*a*. In addition, in the state in which the distal end portion of the paper sheet 201 on the lifting plate 132 is pushed up, detection of the paper sheet 201 by the paper sheet detection sensor 103 is performed.

The open/closed state of the paper feeding cassette 130 can be determined by a later-described paper feeding changeover determining part 180. In other words, when, in the course of printing, for example, the conveyance of the paper sheet in the carrying passages 157 and 158 is sensed by the sensing sensors 154 and 156, if the result of detection by the paper sheet detection sensor 103 is changed from paper sheet presence to paper sheet absence, the paper feeding changeover determining part 180 can determine that the paper sheets in the paper feeding cassette 130 have run out. At the same time, the paper feeding changeover determining part 180 determines that the paper feeding cassette 130 is in the closed state.

In addition, when, in the course of printing, for example, the conveyance of the paper sheet in the carrying passages 157 and 158 is not sensed by the sensing sensors 154 and 156, if the result of detection by the paper sheet detection sensor 103 is changed from paper sheet presence to paper sheet absence, the paper feeding changeover determining part 180 determines that the paper feeding cassette 130 is in the open state.

The paper sheet detection sensor 103 may be mechanical or optical one.

Then, when the paper sheets 201 in the paper feeding cassette 130 are fed, the paper sheets 201 are fed out one by one by the feeding roller 152*a*. Then, the paper sheet 201 is fed to the printing mechanism part 102 along the carrying passage 157 by the driving roller 152 and the driven roller 153 as described above. The paper sheet 201, which has been subjected to printing by the printing mechanism part 102, is conveyed to the paper delivery tray 160 by a driving roller and a driven roller along the carrying passage 158.

Figure 3:
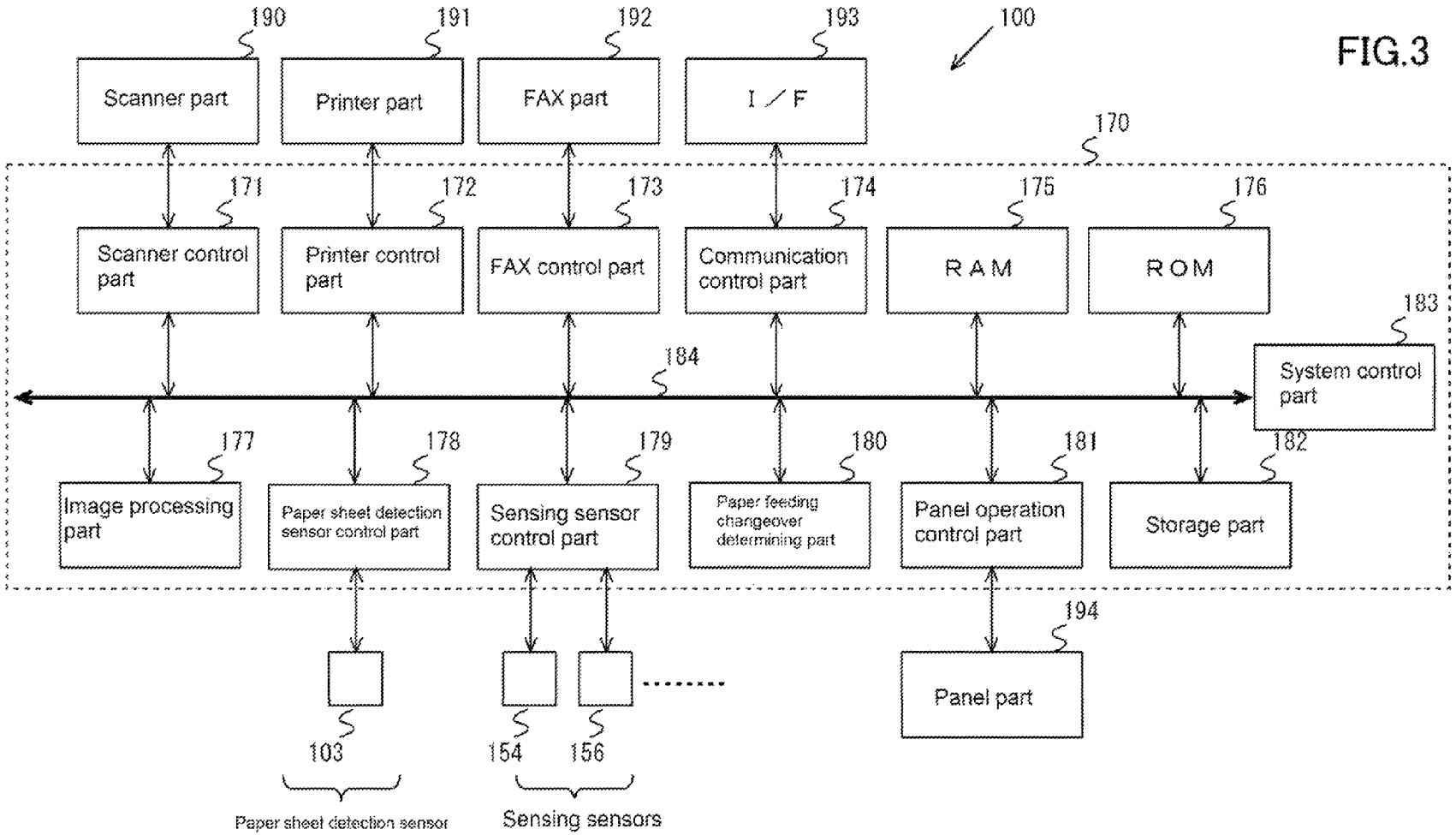
FIG. 3 illustrates the configuration of the MFP in FIG. 1.

Next, with reference to FIG. 3, the configuration of the MFP 100 will be explained. The MFP 100 includes a control part 170, a scanner part 190, a printer part 191, a FAX part 192, an I/F (interface) 193, a paper sheet detection sensor 103, sensing sensors 154 and 156, and a panel part 194.

The scanner part 190 inputs image data of a document read by an image sensor to the control part 170. In other words, the scanner part 190 converts an image signal for the document from the image sensor into digital image data, and sequentially inputs it to the control part 170.

The printer part 191 prints an image on the paper sheet 200, 201 on the basis of the image data outputted from the control part 170. The FAX part 192 transmits the image data outputted from the control part 170 to an opposite party facsimile through a telephone line, and receives image data from the opposite party facsimile to input it to the control part 170. In other words, the FAX part 192 compresses and modulates the image data outputted from the control part 170 to transmit it to the opposite party facsimile, while controlling the connection to the telephone line with an NCU (Network Control Unit). In addition, the FAX part 192 demodulates and expands the image data from the opposite party facsimile to input it to the control part 170, while connecting to the telephone line with the NCU.

The I/F 193 performs a communication with a client terminal, for example, through a network, such as an in-house LAN (Local Area Network).

The paper sheet detection sensor 103 detects the paper sheet 201 that is stored in the paper feeding cassette 130. The sensing sensors 154 and 156 sense the paper sheet 200, 201 that is conveyed along the carrying passages 157 and 158.

The panel part 194 is a circuitry, such as a touch panel that displays operation buttons, and the like, for selecting any one of the printer function, the FAX function, and the scanning function of the MFP 100, and performing various settings. In addition, the panel part 194 displays a setting screen for determining whether the paper feeding is to be changed over to that of the paper sheet 200 from the manual feed tray 140, in the case where paper feeding of the paper sheet 201 from the paper feeding cassette 130 is made impossible (the paper feeding cassette 130 is brought into the open state), if the paper sheet 200 that is possible to be fed is loaded on the manual feed tray 140. In addition, the panel part 194 displays a later-described setting screen for receiving setting of any one of the A4 (thin) 211*a*, A4 (thick) 211*b*, A3 (thin) 211*c*, A3 (thick) 211*d*, B5 (thin) 211*e*, B5 (thick) 211*f*, and official postcard 211*g* in loading the paper sheet 200 on the manual feed tray 140.

The control part 170 controls the entire operation of the MFP 100. The control part 170 includes a scanner control part 171, a printer control part 172, a FAX (facsimile) control part 173, a communication control part 174, an RAM (Random Access Memory) 175, an ROM (Read Only Memory) 176, an image processing part 177, a paper sheet detection sensor control part 178, a sensing sensor control part 179, a paper feeding changeover determining part 180, a panel operation control part 181, a storage part 182, and a system control part 183. In addition, these are connected to a data bus 184. The scanner control part 171, the printer control part 172, the FAX control part 173, the communication control part 174, the image processing part 177, the paper sheet detection sensor control part 178, the sensing sensor control part 179, the paper feeding changeover determining part 180, the panel operation control part 181, and the system control part 183 have a processor, such as a Central Processing Unit (CPU), having one circuit or more, being capable of reading various programs to execute them, and executing various programs that are previously incorporated in the inside. Here, the circuit may be an electronic part in which a plurality of electronic elements are connected by wiring, or an electronic substrate.

The scanner control part 171 controls the reading operation of the scanner part 190. The printer control part 172 performs processing to control the printing operation of the printer part 191. The FAX control part 173 controls the image data transmission/reception operation by the FAX part 192. The communication control part 174 performs processing to control the communication through the I/F 193.

The RAM 175 is a work memory for executing a program. The ROM 176 has an area for storing control programs, and the like, to perform operation check, or the like, of the respective parts. The image processing part 177 performs image processing for image data of a document read by, for example, the scanner part 190.

The paper sheet detection sensor control part 178 performs processing to control the paper sheet detection operation by the paper sheet detection sensor 103. The sensing sensor control part 179 performs processing to control the sensing operation on the paper sheet 200, 201 by the sensing sensors 154 and 156.

When it has been set through the panel part 194 that the paper feeding is to be changed over from that from the paper feeding cassette 130 to that from the manual feed tray 140, in the case where the paper feeding of the paper sheet 201 from the paper feeding cassette 130 is made impossible (the paper feeding cassette 130 is brought into the open state), if the paper sheet 200 that is possible to be fed is loaded on the manual feed tray 140, the paper feeding changeover determining part 180 references a paper feeding changeover possible/impossible information table 210 given in, for example, FIG. 4, to make processing to determine whether or not it is possible to change over the paper feeding to that of the paper sheet 200 from the manual feed tray 140.

Here, the paper feeding changeover possible/impossible information table 210 gives a paper sheet type 210*a*, a paper sheet size 210*b*, a paper sheet weight 210*c*, a paper sheet impact force 210*d*, and a paper feeding changeover possible/impossible indication 210*e*. The paper sheet type 210*a* includes A4 (thin) 211*a*, A4 (thick) 211*b*, A3 (thin) 211*c*, A3 (thick) 211*d*, B5 (thin) 211*e*, B5 (thick) 211*f*, and official postcard 211*g*.

In addition, for the paper sheet size 210*b*, the values based on the standard are given. In addition, for the paper sheet weight 210*c*, the values that have been previously defined are given, for example. In addition, also for the paper sheet impact force 210*d*, the values that have been previously defined are given, for example. For the paper feeding changeover possible/impossible indication 210*e*, whether or not it is possible to change over the paper feeding to that of the paper sheet 200 that is loaded on the manual feed tray 140 when the paper feeding cassette 130 is in the open state is indicated with the word "possible" or "impossible".

In other words, when the paper feeding cassette 130 is in the open state, in changing over the paper feeding to that of the paper sheet 200 that is loaded on the manual feed tray 140, it is required that the above-mentioned engagement of the claw part 125 of the guide member 120 for conveying the paper sheet 200 loaded on the manual feed tray 140 with the recess part of the frame inside of the MFP main body 101, which provides a temporary fixing state, will not be released.

Then, the withstand load and the impact force resistance that can maintain the temporary fixing by the claw part 125 of the guide member 120 are previously defined, and the paper feeding can be changed over to that of a paper sheet 200 having a weight and an impact force that do not exceed the withstand load and impact force resistance that have been previously defined, respectively. Incidentally, in the table in FIG. 4, A4 (thin) 211*a* and B5 (thin) 211*e* are indicated to be possible to make paper feeding changeover. Although the official postcard 211*g* is small in paper size 210*b*, and light in paper weight 210*c*, it is relatively thick when compared to the other types of paper sheet 200, i.e., A4 (thin) 211*a*, A4 (thick) 211*b*, A3 (thin) 211*c*, A3 (thick) 211*d*, B5 (thin) 211*e*, and B5 (thick) 211*f*. Therefore, the impact force to the guide member 120 in paper feeding is large, and the official postcard 211*g* is indicated to be impossible to make paper feeding changeover.

The panel operation control part 181 performs processing to control the display operation of the panel part 194. The storage part 182 has an area for storing the above-described paper feeding changeover possible/impossible information table 210, and the like. The system control part 183 performs processing to control the changeover of paper feeding on the basis of the result of determination by the paper feeding changeover determining part 180, when it has been set mainly through the panel part 136 that changeover of the paper feeding to that from the manual feed tray 140 is to be performed when the paper feeding cassette 130 is in the open state. In the case where the result of determination by the paper feeding changeover determining part 180 shows that changeover is impossible, the system control part 183 causes the panel part 194, through the panel operation control part 181, to give an error display indicating that paper feeding changeover is impossible.

Figure 5:
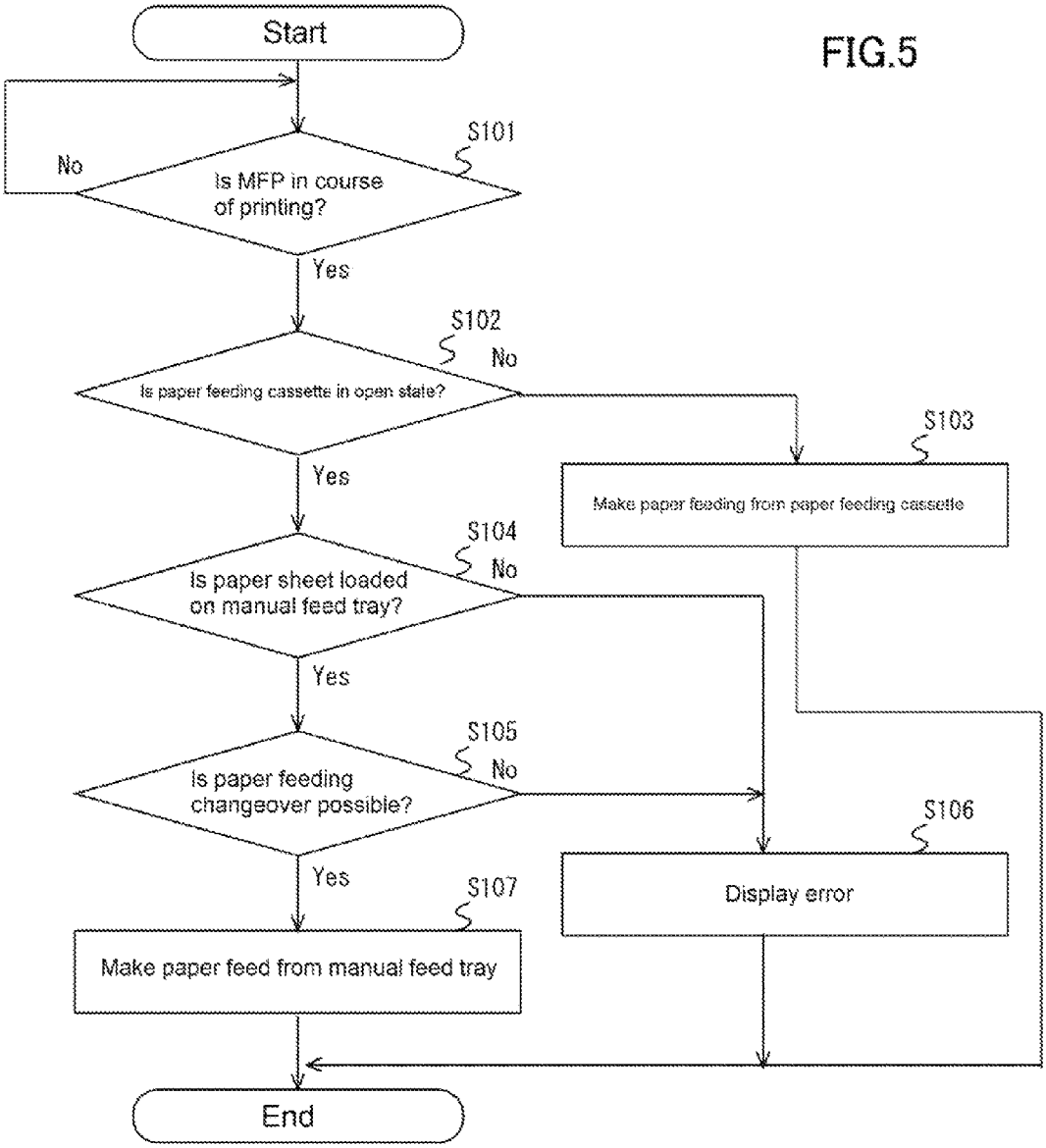
FIG. 5 illustrates the steps of the operation in paper feeding changeover by the MFP in FIG. 1.

Next, with reference to FIG. 5, the operation in paper feeding changeover by the MFP 100 will be explained. In the following explanation, it is assumed that the paper sheet 200 is loaded on the manual feed tray 140. In addition, it is assumed that, through the panel part 194, the type of the paper sheet 200 that is loaded on the manual feed tray 140 has been set, in other words, any one of the above-mentioned A4 (thin) 211*a*, A4 (thick) 211*b*, A3 (thin) 211*c*, A3 (thick) 211*d*, B5 (thin) 211*e*, B5 (thick) 211*f*, and official postcard 211*g* has been set. In addition, it is assumed that, through the panel part 194, it has been set that the paper feeding is to be changed over to that of the paper sheet 200 from the manual feed tray 140, when the paper feeding cassette 130 is in the open state, if the paper sheet 200 that is possible to be fed is loaded on the manual feed tray 140.

First, the paper feeding changeover determining part 180 determines whether or not the MFP 100 is in the course of printing (Step S101). If the MFP 100 is not in the course of printing (NO at Step S101), the paper feeding changeover determining part 180 determines that the MFP 100 is on standby for printing (Step S102). Contrarily to this, if the paper feeding changeover determining part 180 has determined that the MFP 100 is in the course of printing (YES at Step S101), the paper feeding changeover determining part 180 determines whether or not the paper feeding cassette 130 is in the open state (Step S102).

In other words, when, in the course of printing, the conveyance of the paper sheet in the carrying passages 157 and 158 is sensed by the sensing sensors 154 and 156, if the result of detection by the paper sheet detection sensor 103 is not changed from paper sheet presence to paper sheet absence, the paper feeding changeover determining part 180 determines that the paper feeding cassette 130 is in the closed state (NO at Step S102). In this case, the system control part 183 causes the paper sheet feeding from the paper feeding cassette 130 to be continued (Step S103).

Contrarily to this, when, in the course of printing, the conveyance of the paper sheet in the carrying passages 157 and 158 is sensed by the sensing sensors 154 and 156, if the result of detection by the paper sheet detection sensor 103 is changed from paper sheet presence to paper sheet absence, the paper feeding changeover determining part 180 determines that the paper feeding cassette 130 is in the open state (YES at Step S102).

In addition, if the paper feeding changeover determining part 180 determines that the paper feeding cassette 130 is in the open state, the paper feeding changeover determining part 180 determines whether or not the paper sheet 200 is loaded on the manual feed tray 140 (Step S104). If it is determined that the paper sheet 200 is not loaded on the manual feed tray 140 (NO at Step S104), the paper feeding changeover determining part 180 notifies the system control part 183 that the paper sheet 200 is not loaded on the manual feed tray 140.

Thereby, the system control part 183 causes the panel part 194, through the panel operation control part 181, to give an error display indicating that the paper sheet 200 is not loaded on the manual feed tray 140 (Step S106).

Contrarily to this, if it is determined that the paper sheet 200 is loaded on the manual feed tray 140 (YES at Step S104), the paper feeding changeover determining part 180 determines whether or not paper feeding changeover is possible (Step S105).

At this time, the paper feeding changeover determining part 180 collates the type of the paper sheet 200 loaded on the manual feed tray 140 that has been already set through the panel part 194, which is any one of the above-mentioned A4 (thin) 211*a*, A4 (thick) 211*b*, A3 (thin) 211*c*, A3 (thick) 211*d*, B5 (thin) 211*e*, B5 (thick) 211*f*, and official postcard 211*g*, with the above-mentioned paper feeding changeover possible/impossible information table 210, and determines whether or not paper feeding changeover is possible.

Here, if the type of the paper sheet 200 that is loaded on the manual feed tray 140 is other than A4 (thin) 211*a* and B5 (thin) 211*e*, the indication of paper feeding changeover being possible/impossible for that paper sheet 200 in the paper feeding changeover possible/impossible information table 210 is "impossible", and thus the paper feeding changeover determining part 180 determines that paper feeding changeover is impossible (NO at Step S105), and notifies the system control part 183 that paper feeding changeover is impossible. Thereby, the system control part 183 causes the panel part 194, through the panel operation control part 181, to give an error display indicating that paper feeding changeover is impossible (Step S106).

Contrarily to this, if the type of the paper sheet 200 loaded on the manual feed tray 140 is A4 (thin) 211*a* or B5 (thin) 211*e*, the indication of paper sheet changeover being possible/impossible for that paper sheet 200 in the paper feeding changeover possible/impossible information table 210 is "possible", and thus the paper feeding changeover determining part 180 determines that paper feeding changeover is possible (YES at Step S105), and notifies the system control part 183 that paper feeding changeover is possible. Thereby, the system control part 183 changes over the paper feeding to that from the manual feed tray 140 (Step S107).

In this way, in the present embodiment, in the case where the paper feeding cassette 130 is drawn out from the inside of the MFP main body 101, the paper feeding changeover determining part 180 determines whether or not the paper feeding can be changed over to that of the paper sheet 200 from the manual feed tray 140. If the result of determination shows that changeover is possible, the system control part 183 causes paper sheet feeding from the manual feed tray 140 to be performed.

In other words, if, for example, in the course of printing, the paper sheets in the paper feeding cassette 130 have run out, the user may draw out the paper feeding cassette 130 from the inside of the MFP main body 101 to replenish it with new paper sheets 201 and then return it to the inside of the MFP main body 101. In addition, in the event that a paper non-feeding jam has been caused, the user may draw out the paper feeding cassette 130 from the inside of the MFP main body 101 to remove the jammed paper sheet, and then return the paper feeding cassette 130 to the inside of the MFP main body 101. In such cases, since the paper feeding cassette 130 has been drawn out from the inside of the MFP main body 101, paper sheet feeding from the paper feeding cassette 130 cannot be performed. Therefore, an error is caused with the printing on the paper sheet being interrupted.

Then, if the paper feeding changeover determining part 180 determines that the paper sheet 200 loaded on the manual feed tray 140 can be fed, the system control part 183 changes over the paper feeding to that from the manual feed tray 140. Therefore, even if the paper feeding cassette 130 is in the open state (the state in which it is drawn out from the MFP main body 101), paper sheet feeding from the manual feed tray 140 can be positively to be performed. Moreover, the printing interrupt time can be shortened.

In addition, the paper feeding changeover determining part 180 references the paper feeding changeover possible/impossible information table 210, which gives the defined values of weight and impact force for each of a variety of types of paper sheet 200, and the indication of paper sheet changeover being possible/impossible for the respective types of paper sheet 200, thereby determining whether or not paper feeding changeover is possible. Thereby, even if the paper feeding cassette 130 is in the open state, paper sheet feeding from the manual feed tray 140 can be positively performed without causing position displacement of the guide member 120, and the like, that may be caused by paper feeding of the paper sheet 200 from the manual feed tray 140.

What is claimed is:

1. An image forming apparatus comprising:

a paper feeding cassette that is loaded in a detachable manner in the inside of an apparatus main body, a guide member that is temporarily fixed in the inside of the apparatus main body above the paper feeding cassette, constituting a carrying passage for a paper sheet from a manual feed tray, a panel part that receives a paper sheet type of a paper sheet loaded on the manual feed tray, a storage part that, for each of a variety of paper sheet types, stores information showing, based on defined values of weight and impact force of the paper sheet type of the variety and the withstand load and impact force resistance that is capable of maintaining the temporary fixing of the guide member, that paper feeding changeover to the paper sheet type of the variety is possible if the weight or the impact force of the paper sheet type of the variety does not exceed the withstand load or the impact force resistance, respectively, and that paper feeding changeover to the paper sheet type of the variety is impossible if the weight or the impact force of the paper sheet type of the variety exceeds the withstand load or the impact force resistance, respectively, a sensor for detecting the cassette is drawn out;

a paper feeding changeover determining part that determines whether the cassette is drawn out from the inside of the apparatus main body and, in the case where the paper feeding cassette is drawn out from the inside of the apparatus main body, performs processing to determine whether or not paper sheet feeding changeover to the paper sheet type received by the panel part is possible based on the information stored in the storage part, and a system control part that, if the result of the determination by the paper feeding changeover determining part shows that changeover is possible, performs processing to cause paper sheet feeding from the manual feed tray to be made.

2. An image forming apparatus comprising:

a paper feeding cassette that is loaded in a detachable manner in the inside of an apparatus main body, a guide member that is temporarily fixed in the inside of the apparatus main body above the paper feeding cassette, constituting a carrying passage for a paper sheet from a manual feed tray, a panel part that receives a paper sheet type of a paper sheet loaded on the manual feed tray;

a sensor for detecting the cassette is drawn out;

a paper feeding changeover determining part that determines whether the cassette is drawn out from the inside of the apparatus main body and, in the case where the paper feeding cassette is drawn out from the inside of the apparatus main body, performs processing to determine whether or not paper sheet feeding is capable of being changed over to paper sheet feeding from the manual feed tray, and a system control part that, if the result of the determination by the paper feeding changeover determining part shows that changeover is possible, performs processing to cause paper sheet feeding from the manual feed tray to be made, wherein the paper feeding changeover determining part performs processing to determine, based on the paper sheet type received by the panel part, the weight of the paper sheet loaded on the manual feed tray or the impact force thereof and compare the weight of the paper sheet loaded on the manual feed tray or the impact force thereof to the guide member in paper feeding with a withstand load or impact force resistance that is capable of maintaining the temporary fixing of the guide member, and if the weight or impact force of the paper sheet does not exceed the withstand load or impact force resistance of the guide member, respectively, performs processing to determine that paper sheet feeding is capable of being changed over to paper sheet feeding from the manual feed tray.

3. The image forming apparatus according to claim 2, wherein the paper feeding changeover determining part performs processing to reference a paper feeding changeover information table that gives defined values of the weight and the impact force for each of a variety of types of paper sheet, and an indication of whether paper sheet changeover is possible for the respective types of paper sheet, and performs the processing to determine whether or not paper feeding changeover is possible.

4. The image forming apparatus according to claim 3, further comprising a panel part that receives a paper sheet type of the paper sheet loaded on the manual feed tray.

* * * * *